United States Patent [19]

Rippelmeyer et al.

[11] 4,188,181

[45] Feb. 12, 1980

[54] GAS BURNER CONTROL SYSTEM

[75] Inventors: Dennis M. Rippelmeyer, Waterloo, Ill.; Robert L. Baysinger, St. Louis, Mo.

[73] Assignee: Emerson Electric Co., St. Louis, Mo.

[21] Appl. No.: 899,550

[22] Filed: Apr. 24, 1978

[51] Int. Cl.[2] ..... F23N 5/00

[52] U.S. Cl. ..... 431/66; 431/67; 431/71; 431/73

[58] Field of Search ..... 431/25, 46, 59, 66, 431/67, 69, 71, 78, 73

[56] References Cited

U.S. PATENT DOCUMENTS

| | | | |
|---|---|---|---|
| 2,640,920 | 6/1953 | Cairns, Jr. | 431/25 X |
| 3,196,928 | 7/1965 | LaPointe et al. | 431/73 |

*Primary Examiner*—Carroll B. Dority, Jr.

*Assistant Examiner*—Lee E. Barrett

*Attorney, Agent, or Firm*—Paul A. Becker, Sr.

[57] ABSTRACT

A gas burner control system utilizes an electrical resistance igniter to ignite a main burner. Electronic sensing means is located adjacent the burner and adjacent a portion of the igniter where opposite voltage polarity exists between the igniter and sensing means. Current flows from the igniter to the sensing means when the igniter is heated above ignition temperature. Circuit means is responsive to such current flow to de-energize the igniter and enable gas to flow for a timed trial ignition period, the igniter having sufficient mass to remain at or above ignition temperature for the trial ignition period. When ignition occurs, the circuit means is responsive to current flow through burner flame from the sensing means to the burner to maintain gas flow.

9 Claims, 1 Drawing Figure

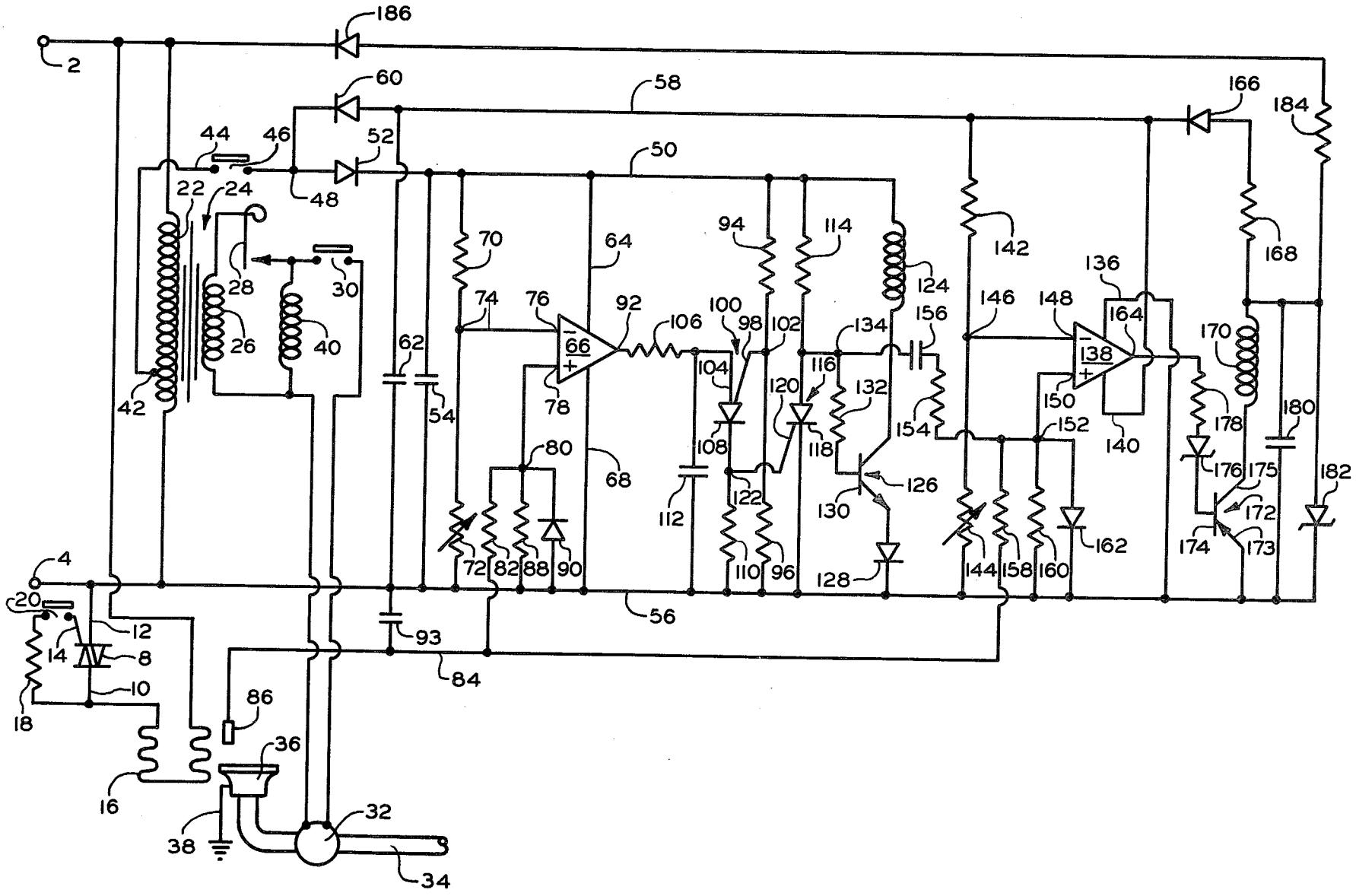

GAS BURNER CONTROL SYSTEM

This invention relates to gas burner control systems wherein a main burner is directly ignited, and particularly, to systems using an electrical resistance type igniter.

The prior art discloses many gas burner control systems wherein a main burner is ignited directly rather than by a pilot burner. Such systems have generally used sparks or electrical resistance type igniter to effect ignition.

Where electrical resistance igniters are used, the desirable sequence of system operation is to energize the igniter, and when the igniter is hot enough to ignite gas, to allow gas to flow. It has also been generally desirable to shut off the igniter or at least allow it to cool after gas is ignited, so as to extend the life of the igniter. Prior art systems which provide these functions have generally employed optical or radiant heat sensors responsive to the glow of the igniter, or temperature sensors responsive to the temperature of the igniter. Typical of such prior art systems are the systems disclosed in U.S. Pat. No. 3,589,846 and U.S. Pat. No. Re.25,976.

An object of this invention is to provide a direct ignition gas burner control system using an electrical resistance type igniter in which electronic sensing means controls operation of the system.

A further object is to provide a direct ignition gas burner control system using an electrical resistance type igniter wherein electrical circuit means is responsive to current flow from the igniter to the electronic sensing means to cause the igniter to be de-energized and to allow gas to flow; and wherein the electrical circuit means is further responsive to current flow through burner flame from the sensing means to the burner to allow gas flow to continue.

Other objects and advantages will appear from the following description when read in connection with the accompanying drawing.

The single FIGURE of the drawing is a schematic illustration of a gas burner control system constructed in accordance with the invention.

DESCRIPTION OF THE PREFERRED EMBODIMENT

Referring to the single FIGURE of the drawing, the gas burner control system is adapted to be electrically energized by connecting the system to terminals 2 and 4 of a conventional 120 volt alternating current power source.

Series connected across power source terminals 2 and 4 is a triac 8 having main terminals 10 and 12 and a gate 14, and an electrical resistance igniter 16. Series connected between the main terminal 10 and gate 14 is a resistor 18 and a set of normally open contacts 20. When contacts 20 are closed, triac 8 becomes conductive and enables igniter 16 to be energized. The igniter 16 is a silicon-carbide device having resistance characteristics such that, when energized, it heats to a temperature sufficient to ignite gas in a short time, such as in ten to fifteen seconds.

Also connected across terminals 2 and 4 is the primary winding 22 of a voltage step-down transformer 24. Connected across the secondary winding 26 of transformer 24 through a thermostat 28 and a set of normally open contacts 30 is a gas valve 32 which controls the flow of gas through a supply conduit 34 to a burner 36 which is located adjacent igniter 16 and which is grounded at 38. Also connected across the secondary winding 26 through thermostat 28 is an electromagnetic winding 40.

The primary winding 22 of transformer 24 is tapped at 42. Connected to tap 42 by a lead 44 is a set of normally open contacts 46 controlled by winding 40. When winding 40 is energized, contacts 46 are closed, and approximately 12 volts a.c. appears at a point 48 downstream from contacts 46.

Connected to point 48 through a lead 50 is a diode 52. Diode 52 is so connected that its polarity is such that it conducts during the half cycle when power source terminal 2 is positive. A filter capacitor 54 is connected between lead 50 and a lead 56, lead 56 being connected to terminal 4. Capacitor 54 and transformer winding 22, as tapped at 42, combine to maintain lead 50 at a relatively constant positive voltage potential with respect to lead 56.

Connected to point 48 through a lead 58 is a diode 60 connected so that it conducts during the other half cycle when power source terminal 4 is positive. A filter capacitor 62, connected between lead 58 and lead 56, combines with transformer winding 22, as tapped at 42, to maintain lead 58 at a relatively constant negative voltage potential with respect to lead 56.

The positive D.C. supply volts lead 64 of an operational amplifier 66 is connected to positive lead 50 and the negative D.C. supply volts lead 68 is connected to common lead 56. Series connected between leads 50 and 56 are resistors 70 and 72, resistor 72 being factory adjustable to enable the establishing of a reference voltage potential at a point 74 between resistors 70 and 72. The inverting input terminal 76 of amplifier 66 is connected to point 74 and the non-inverting input terminal 78 of amplifier 66 is connected to a point 80.

Point 80 is connected through a resistor 82 to a lead 84 which, in turn, is connected to a sensing probe 86 located adjacent igniter 16 and burner 36. Point 80 is also connected to common lead 56 through a parallel connected resistor 88 and diode 90. In the absence of current flow through resistor 82, point 80, which is connected to non-inverting input terminal 78, is less positive than point 74, which is connected to inverting input terminal 76. Under these conditions, the internal impedance between the output terminal 92 and the positive D.C. supply volts lead 64 is quite large so that the output terminal 92 is essentially at the same potential as common lead 56. Under these conditions, there is essentially no output from amplifier 66.

When sufficient current flows from sensing probe 86 through resistors 82 and 88, which as will be described, occurs when the igniter 16 is heated to a temperature above that required to ignite gas, point 80 becomes more positive than point 74, which condition causes the internal impedance between output terminal 92 and the positive D.C. supply volts lead 64 to become quite small. Output terminal 92 is then essentially at the same potential as the positive lead 50. Under these conditions, the output of amplifier 66 increases.

When current flows from common lead 56 to sensing probe 86, which as will be described, occurs when a flame appears at burner 36, the current flow is in the opposite direction, the flow being through resistor 88 and diode 90 to point 80, and from point 80 through resistor 82 to probe 86. Diode 90 limits the potential at point 80 to a value sufficiently less than the positive potential at point 74 so that when burner flame exists, there again is essentially no output from amplifier 66. A capacitor 93, connected between leads 56 and 84, is effective to filter current flow when current flows to the probe 86 and also when it flows from the probe 86.

Series connected between positive lead 50 and common lead 56 are resistors 94 and 96. The gate 98 of a programmable unijunction transistor (PUT) 100 is connected to a point 102 between resistors 94 and 96. The anode 104 of PUT 100 is connected through a resistor 106 to the output terminal 92 of operational amplifier 66. The cathode 108 of PUT 100 is connected through a resistor 110 to common lead 56. A capacitor 112 is connected between the anode 104 of PUT 100 and common lead 56.

When there is essentially no output from operational amplifier 66, the potential at point 102, which is also the potential on the gate 98 of PUT 100, is more positive than the potential on anode 104, causing PUT 100 to be non-conductive. When the output of operational amplifier 66 increases, capacitor 112 charges through resistor 106. In approximately two seconds, capacitor 112 is sufficiently charged to cause the anode 104 of PUT 100 to be sufficiently more positive than the gate 98 resulting in PUT 100 becoming conductive. Capacitor 112 thus provides a time delay to insure that PUT 100 will not become conductive due to a false output signal of very short duration from amplifier 66.

Also series connected between positive lead 50 and common lead 56 are a resistor 114 and an SCR 116. The cathode 118 of SCR 116 is connected to lead 56 and the gate 120 is connected to a point 122 between the cathode 108 of PUT 100 and resistor 110. Thus, SCR 116 is non-conductive when PUT 100 is non-conductive and is gated on when PUT 100 becomes conductive.

Also series connected between positive lead 50 and common lead 56 are an electromagnetic winding 124 which is associated with contacts 20 in the gating circuit of triac 8, an NPN transistor 126, and a diode 128. The base 130 of transistor 126 is connected through a resistor 132 to a point 134 between resistor 114 and SCR 116. When SCR 116 is off, transistor 126 is biased on through resistors 114 and 132, effecting the energizing of winding 124 and the closing of contacts 20 which enables the igniter 16 to be energized. When SCR 116 is conducting, it effectively shunts bias resistor 132, causing transistor 126 to shut off. With transistor 126 off, winding 124 is de-energized, effecting the opening of contacts 20 and the de-energizing of igniter 16. Diode 128 insures that transistor 126 is biased off when SCR 116 is conducting.

The positive D.C. supply volts lead 136 of a second operational amplifier 138 is connected to common lead 56, and the negative D.C. supply volts lead 140 is connected to negative lead 58. Connected in series between leads 58 and 56 are resistors 142 and 144, resistor 144 being factory adjustable to enable the establishing of a reference voltage potential at a point 146 between resistors 142 and 144. The inverting input terminal 148 of amplifier 138 is connected to point 146 and the non-inverting input terminal 150 is connected to a point 152.

Point 152 is connected through a resistor 154 and a capacitor 156 to point 134. Point 152 is also connected through a resistor 158 and lead 84 to sensing probe 86, and through a parallel connected resistor 160 and diode 162 to common lead 56. When SCR 116 is off, capacitor 156 is charged through resistors 114 and 154, and diode 162. Therefore, in the absence of any current flow through resistor 158, point 152, which is connected to the non-inverting input terminal 150 of amplifier 138, is less negative than point 146, which is connected to the inverting input terminal 148. Under these conditions, the internal impedance between the output terminal 164 and the positive D.C. supply volts lead 136 is quite small, so that the output terminal 164 is essentially at the same potential as common lead 56. When current flows from sensing probe 86 through resistor 158, point 152 remains less negative than point 146, maintaining amplifier 138 in the condition described above.

When SCR 116 becomes conductive, capacitor 156 discharges through SCR 116, resistors 160 and 154, causing point 152 to become more negative than point 146. Under these conditions, the internal impedance between output terminal 164 and the negative D.C. supply volts lead 140 becomes quite small, so that the output terminal 164 is then essentially at the same potential as negative lead 58. When burner flame appears, point 152 is maintained more negative than point 146 by the effect of flame current flow from common lead 56 through resistors 160 and 158. The time constant of the discharge circuit of capacitor 156 is such that if current flow through resistors 160 and 158 does not occur in approximately four seconds, point 152 again becomes less negative than point 146.

Series connected across leads 58 and 56 are a diode 166, a resistor 168, an electromagnetic winding 170 which is associated with contacts 30 in the circuit for energizing gas valve 32, and a PNP transistor 172 having an emitter 173, a base 174, and a collector 175. The base 174 of transistor 172 is connected to the output terminal 164 of amplifier 138 through a zener diode 176 and a resistor 178.

Under conditions wherein the non-inverting input terminal 150 of amplifier 138 is less negative than the inverting input terminal 148 so that output terminal 164 is essentially at the same voltage potential as common lead 56, the proper bias for turning on transistor 172 does not exist in that base 174 is not sufficiently negative with respect to emitter 173. Under these conditions, transistor 172 is biased off. Zener diode 176 insures that transistor 172 remains biased off under these conditions. When terminal 150 becomes more negative than terminal 148 so that output terminal 164 is essentially at the same voltage potential as negative lead 58, the proper bias on transistor 172 exists and transistor 172 is biased on.

A storage capacitor 180 is connected in parallel with series connected winding 170 and transistor 172. A zener diode 182 is connected across capacitor 180 to limit the voltage level thereof. Connected in series between one end of capacitor 180 and power source terminal 2 is a resistor 184 and a diode 186.

When transistor 172 is off, capacitor 180 quickly charges to a low voltage level, approximately 12 volts, through a circuit as follows: from transformer primary winding 22, through lead 56, resistor 168, diode 166, lead 58, diode 60, contacts 46, and lead 44 to transformer tap 42. This 12 volt charge is not sufficient to enable capacitor 180, upon discharge through winding 170 and transistor 172, to energize winding 170 sufficiently to cause contacts 30 to close. Capacitor 180 charges at a slower rate to a higher voltage level, approximately 32 volts, as determined by zener diode 182, through a circuit from power source terminal 4, lead 56, resistor 184 and diode 186 to power source terminal 2. When transistor 172 is turned on after being off for a sufficiently long time period to enable capacitor 180 to charge to the higher voltage, capacitor 180 discharges through transistor 172 and winding 170, sufficiently energizing winding 170 to effect the closing of contacts 30. As long as transistor 172 is maintained conductive, winding 170 is maintained energized on alternate half cycles by the transformer winding 22, as tapped at 42, and by capacitor 62.

OPERATION

When the thermostat 28 closes its contacts, electromagnetic winding 40 is energized by the transformer secondary winding 26 and closes its associated contacts 46. In the absence of current flow through resistor 82, the non-inverting input terminal 78 of operational amplifier 66 is essentially at the voltage potential of common lead 56 and is therefore less positive than the voltage potential on the inverting input terminal 76 which is connected to point 74 between resistors 70 and 72. Under these conditions, the output of amplifier 66 is insufficient to effect charging of capacitor 112 to the firing voltage of PUT 100. Therefore, PUT 100 is non-conductive and SCR 116 is non-conductive. With SCR 116 non-conductive, transistor 126 is biased on through resistors 114 and 132, the base-emitter circuit of transistor 126, and diode 128. With transistor 126 on, winding 124 is energized, effecting the closing of contacts 20.

With SCR 116 off, capacitor 156 charges through resistors 114 and 154, and diode 162, so that point 152 and thus the potential on non-inverting input terminal 150 of operational amplifier 138 is more positive than the potential on common lead 56. The inverting input terminal 148 is connected to point 146 between resistors 142 and 144 and is at a more negative potential than common lead 56. Under these conditions, the internal impedance of amplifier 138 between output terminal 164 and positive D.C. supply volts lead 136 is sufficiently small so that transistor 172 is biased off. With transistor 172 off, winding 170, which controls contacts 30 in the gas valve circuit, is de-energized. Transistor 172 being off also permits capacitor 180 to charge.

The closing of contacts 20 enables triac 8 to be gated into conduction. Current then flows through igniter 16, causing it to heat. As the igniter 16 gets hotter, current begins to flow from the igniter through air to the sensing probe 86.

While not known for certain, it is believed that the current flow is caused by ionization of the air space between the igniter 16 and probe 86 due to the high temperature attained by the igniter 16 and due to the opposite voltage potential existing between igniter 16 and probe 86. It will be noted that probe 86 is positioned adjacent a beginning portion of a serpentine form of igniter 16, that the beginning portion of igniter 16 is connected to power source terminal 2, and that probe 86 is effectively connected to power source terminal 4. Under these conditions, igniter 16 and probe 86 are of opposite electrical polarity. For reasons not fully understood by applicants at this time, the current is effectively unidirectional. That is to say, even though terminals 2 and 4 are connected to an alternating current power source, the majority of the current flow is in the direction from the igniter 16 to the probe 86.

A path for the above unidirectional current flow, filtered by capacitor 93, is from power source terminal 2, igniter 16, the air space between igniter 16 and probe 86, probe 86, lead 84, resistor 82, resistor 88, and common lead 56 to power source terminal 4. As the igniter continues to heat to a higher temperature, more current flows until the flow is sufficient to cause point 80 to become more positive than point 74. This condition exists after the igniter 16 has been energized for approximately ten to fifteen seconds, at which time the igniter 16 is at approximately 2600° F., well above the temperature required to ignite gas.

With point 80 more positive than point 74, the output of operational amplifier 66 becomes sufficient to initiate charging of capacitor 112 through resistor 106. In approximately two seconds, capacitor 112 is sufficiently charged to cause the potential on anode 104 of PUT 100 to be approximately 0.6 volts greater than the potential on gate 98 which is connected to point 102 between resistors 94 and 96. PUT 100 therefore becomes conductive and gates SCR 116 into conduction.

When SCR 116 becomes conductive, it shunts the biasing means for transistor 126, causing transistor 126 to shut off. Winding 124 is de-energized which effects the opening of contacts 20 in the gating circuit of triac 8. Triac 8 becomes non-conductive, causing the igniter 16 to be de-energized, which causes the igniter to cool. As the igniter cools, the flow of current from the igniter 16 to the probe 86 decreases.

Also when SCR 116 becomes conductive, capacitor 156 discharges through SCR 116, resistor 160, and resistor 154, causing point 152 to become more negative than point 146. Under these conditions, transistor 172 is biased on. With transistor 172 on, capacitor 180 discharges through transistor 172 and winding 170, causing contacts 30 to close which enables the gas valve 32 to open.

The mass of the igniter 16 is sufficient so that it remains at or above ignition temperature for gas for approximately four seconds after being de-energized. Thus, when gas valve 32 opens, the gas is ignited.

When burner flame appears, a current flows from probe 86 through the flame to burner 36. The current flow is unidirectional, due to flame rectification, and is in a direction, with respect to the probe 86, opposite from the direction of the current flow from the igniter 16 to the probe 86 due to the igniter 16 being above ignition temperature. A path for the flame current, filtered by capacitor 93, is from power source terminal 4, lead 56, resistor 160, resistor 158, lead 84, probe 86, the flame, and burner 36 to ground at 38. This current flow maintains point 152 at a potential more negative than point 146 so that transistor 172 remains on, enabling winding 170 to remain energized.

Another path for the flame current is from lead 56, through diode 90, and resistor 82 to lead 84. Point 80 is thus assured, due to the effect of the igniter 16 cooling and the effect of flame current, of becoming less positive than point 74 so that there is essentially no output from operational amplifier 66. Under these conditions, PUT 100 is non-conductive, SCR 116 remains conductive due to non-interrupted unidirectional holding current supplied from lead 50, and transistor 126 remains off.

As previously described, the discharging of capacitor 156 is capable of maintaining point 152 more negative than point 146 for approximately four seconds. Therefore, if burner flame does not appear within four seconds after gas valve 32 is opened, operational amplifier 138 causes transistor 172 to shut off, de-energizing winding 170 which, in turn, effects the closing of gas valve 32. Under these conditions, another attempt at ignition may be made by cycling the thermostat 28. Specifically, opening the thermostat 28 terminates the current flow through SCR 116, causing it to shut off. With SCR 116 off, transistor 126 can then be biased on when the thermostat 28 is subsequently closed.

Should the burner flame be extinguished for any reason, such as due to a gas interruption during a normal burner cycle, the flame current would cease, causing operational amplifier 138 to again bias transistor 172 off. As with a failure to ignite, another attempt can be made at ignition by cycling the thermostat 28.

In the event of a power failure, flame current ceases, winding 170 is de-energized, and SCR 116 becomes non-conductive. Upon resumption of power, the system would automatically retry for ignition without having to cycle the thermostat 28.

Thus, regardless of the cause of flame failure, the system prevents gas from again flowing until the igniter 16 is in a condition to ignite gas.

While the invention has been illustrated and described in detail in the drawing and foregoing description, it will be recognized that many changes and modifications will occur to those skilled in the art. For example, although the preferred embodiment utilizes a single probe 86, it is to be understood that with minor changes, two probes, one for conduction of current from the igniter 16 to the probe and the other for conduction of flame current from the probe to the burner 36, could be utilized. In such a two probe system, resistor 158 would be connected to a second probe instead of to probe 86, and an additional filter capacitor would be connected between the second probe and common lead 56. It is therefore intended, by the appended claims, to cover any such changes and modifications as fall within the true spirit and scope of the invention.

We claim:

1. In a gas burner control system, a burner;

an electrical resistance igniter for igniting said burner;

sensing means located in close proximity to said igniter and said burner; and circuit means connected to said sensing means responsive to absence of current flow between said igniter and said sensing means when said igniter is below ignition temperature for effecting energizing of said igniter, and responsive to presence of current flow between said igniter and said sensing means when said igniter is above ignition temperature for effecting flow of gas to said burner, and responsive to presence of current flow between said sensing means and said burner when burner flame exists for maintaining gas flow to said burner.

2. In a gas burner control system, a burner;

an electrical resistance igniter for igniting said burner;

sensing means located in close proximity to said igniter and said burner;

first circuit means connected to said sensing means responsive to absence of current flow between said igniter and said sensing means when said igniter is below ignition temperature for effecting energizing of said igniter, and responsive to presence of current flow between said igniter and said sensing means when said igniter is above ignition temperature for effecting de-energizing of said igniter; and second circuit means connected to said sensing means and to said first circuit means responsive to de-energizing of said igniter for enabling gas to flow to said burner, and responsive to presence of current flow between said sensing means and said burner when burner flame exists for maintaining gas flow to said burner.

3. The gas burner control system claimed in claim 2 wherein said igniter is connected across a power source for energizing thereof, and said sensing means comprises a probe positioned adjacent a beginning portion of said igniter and connected through said first circuit means to an end portion of said igniter whereby said probe and said beginning portion of said igniter are of opposite electrical polarity.

4. In a gas burner control system, a burner;

an electrical resistance igniter for igniting said burner having a beginning portion connected to one side of a power source and an end portion connected to an opposite polarity side of said power source, and having sufficient mass to remain above ignition temperature for a timed trial ignition period after being de-energized;

a sensing probe located in close proximity to said burner and to said beginning portion of said igniter and electrically connected to said opposite polarity side of said power source through electrically operated control means;

said control means including first circuit means connected to said probe for effecting energizing of said igniter to a temperature above ignition temperature and for effecting de-energizing of said igniter in response to a sufficient current flow between said igniter and said probe which occurs when said igniter is above ignition temperature;

said control means further including second circuit means connected to said first circuit means and responsive to de-energizing of said igniter for allowing gas to flow to said burner for said trial ignition period; and said second circuit means also being connected to said probe and responsive to current flow between said probe and said burner through burner flame for allowing gas to continue to flow after said trial ignition period.

5. The gas burner control system claimed in claim 4 wherein said second circuit means is connected to said first circuit means through a capacitor, said capacitor being charged when said igniter is energized and being discharged when said igniter is de-energized to provide said trial ignition period.

6. In a gas burner control system, a burner;

an A.C. power source;

an electrical resistance igniter for igniting said burner connected across said A.C. power source through a first switch;

a sensing probe;

a voltage step-down transformer having a primary winding connected across said A.C. power source and a secondary winding;

first circuit means connected to said probe and across a portion of said primary winding;

said probe being positioned adjacent a beginning portion of said igniter and connected through said first circuit means to an end portion of said igniter so that when said igniter is heated above a temperature sufficient to ignite gas, current flows from said igniter to said probe;

said first circuit means including a series connected second switch and an electrical winding associated with an electrically operated control means for controlling conduction of said first switch;

said first circuit means further including means effective in absence of said current flow from said igniter to said probe to cause conduction of said second switch and effective in presence of said current flow to prevent conduction thereof;

second circuit means connected to said probe and said first circuit means and across said portion of said primary winding;

said probe being positioned adjacent said burner so that when burner flame is established, current flows from said probe to said burner;

said second circuit means including a series connected third switch and an electrical winding associated with an electrically operated control means for controlling flow of gas to said burner;

said second circuit means further including means responsive to conduction of said second switch for preventing conduction of said third switch and responsive to subsequent non-conduction of said second switch for effecting conduction of said third switch, and responsive to said current flow from said probe to said burner for maintaining conduction of said third switch; and a capacitor connected across said A.C. power source and in parallel with said series connected third switch and electrical winding for effecting flow of gas upon discharge thereof through said series connected third switch and electrical winding.

7. The gas burner control system claimed in claim 6 wherein said second switch comprises a first transistor and wherein said first circuit means includes a first operational amplifier and an SCR, said SCR being connected across the base-emitter circuit of said first transistor and effective, when conducting, to prevent conduction of said first transistor, said first amplifier having an input terminal connected to said probe and an output terminal connected to the gate electrode of said SCR, said first amplifier being responsive to said current flow from said igniter to said probe for effecting gating of said SCR.

8. The gas burner control system claimed in claim 7 wherein said first circuit means further includes gating circuit means for said SCR comprising a programmable unijunction transistor having its cathode connected to said gate electrode of said SCR and its anode connected to said output terminal of said first amplifier, and a capacitor connected across the anode-cathode circuit of said programmable unijunction transistor.

9. The gas burner control system claimed in claim 7 wherein said third switch comprises a second transistor and wherein said second circuit means includes a second operational amplifier having an input terminal connected to said probe and coupled through energy storage means to the anode of said SCR and having an output terminal connected to said second transistor, said energy storage means being effective when said SCR is gated on to cause said second transistor to become conductive, and said current flow from said probe to said burner being effective when burner flame exists to maintain conduction of said second transistor.

* * * * *